United States Patent [19]

Simpson

[11] Patent Number: 4,811,438

[45] Date of Patent: Mar. 14, 1989

[54] STORAGE UNIT FOR BED ASSEMBLY

[75] Inventor: Danny Simpson, Seymour, Ind.

[73] Assignee: Lear Siegler Seymour Corporation, Seymour, Ind.

[21] Appl. No.: 172,777

[22] Filed: Mar. 28, 1988

[51] Int. Cl.[4] ..... A47C 19/22

[52] U.S. Cl. ..... 5/308; 297/192

[58] Field of Search ..... 5/308, 58, 2 R, 279 R; 297/192

[56] References Cited

U.S. PATENT DOCUMENTS

| | | | |
|---|---|---|---|
| 140,306 | 6/1873 | Rand et al. | 5/308 |
| 1,177,390 | 3/1916 | Daniel | 5/308 |
| 3,745,596 | 7/1973 | Copeland | 5/308 |

FOREIGN PATENT DOCUMENTS

| | | | |
|---|---|---|---|
| 19310 | 11/1890 | United Kingdom | 5/308 |

*Primary Examiner*—Alexander Grosz

*Attorney, Agent, or Firm*—Reising, Ethington, Barnard, Perry & Milton

[57] ABSTRACT

A bed frame assembly (11) includes a plurality of rails (14,16) connected together to form a substantially rectangular frame (12). Legs support the rails (14,16) above the floor (24). A drawer support structure (32) supports a drawer (28) below the bed frame (12). The drawer support structure (32) is substantially C-shaped when viewed in plan view and has two spaced parallel portions (34,36) and an intermediate portion (38) interconnecting the parallel portions (34,36). The parallel portions (34,36) define a plane. The drawer support structure (32) transfers weight applied to the drawer (28) directly from the drawer support structure (32) to the floor (24). The floor support structure (32) includes an integral portion curving below the plane defined by the parallel portion (32,34) for engaging the floor (24).

20 Claims, 2 Drawing Sheets

Fig-1
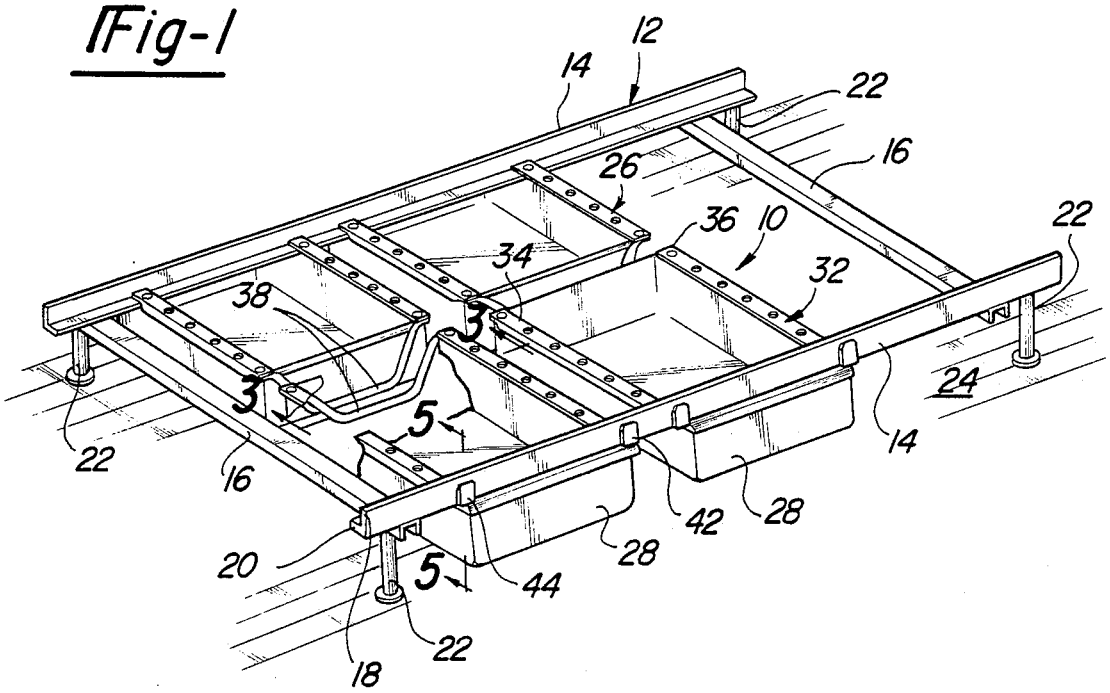
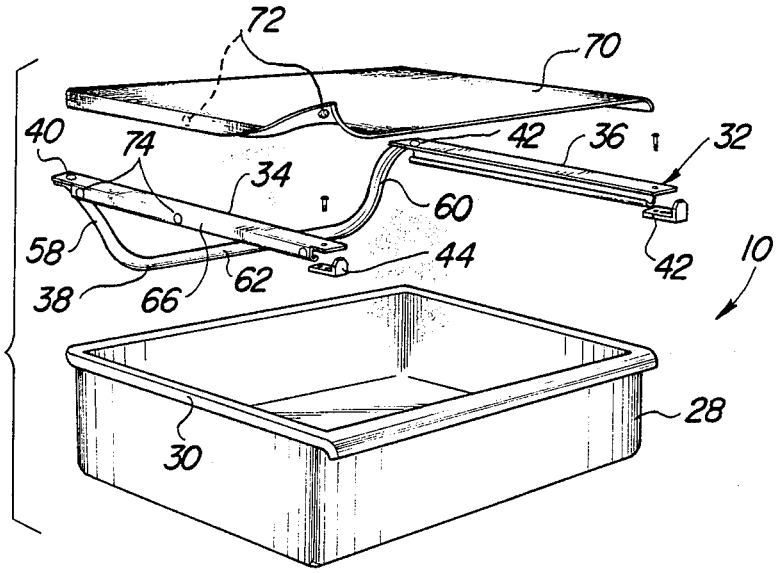
Fig-2

STORAGE UNIT FOR BED ASSEMBLY

TECHNICAL FIELD

The present invention relates to a storage unit to be mounted as an integral part of a bed frame.

BACKGROUND ART

The area below a bed frame is normally unutilizable space. Manufacturers have attempted to utilize this space by providing drawer assemblies which are either independent or attached directly to a bed frame. For example, the U.S. Pat. Nos. 726,393 to Barcalo, issued Apr. 28, 1903; 152,357 to French, issued June 23, 1974; 1,053,640 to Philips, issued Feb. 18, 1913; and 3,745,596 to Copeland, issued July 17, 1973 are examples of bed frame and storage compartment combinations. In each of the aforementioned assemblies, all of the weight placed on the storage drawers or frames of the units are transferred completely to the bed frames. Therefore, the limiting factor in supporting the stored weight is the bed frame structure.

The British Patent No. 19,310, issued Oct. 3, 1891, discloses a drawer supported below a bed by a support frame. The ends of the frame are connected to the bed frame. However, the British patent does not disclose weight transfer means for transferring weight applied to the drawer directly from the drawer support to a support surface.

The British Patent No. 4438, issued Mar. 22, 1916, discloses a bed frame with drawers and a drawer support frame below the bed. The drawer support frame is a boxing having two parallel portions and an intermediate bed portion. The drawer support frame parallel portions are supported by the bed frame above the floor. Two subsidiary legs assist in supporting the frame-work carrying the ends of the tray supported within the frame.

These prior art patents do not address the concerns of present day manufactures. It is presently desirable to maximize utilizable space below beds, provide ease of storage, provide ease of attachment of the unit, provide ability of the unit to contain significant amount of stored articles, and increase the weight storage capability of the storage units. At the same time, it is desirable to provide a simplified unit which is easy to assembly and attach to a bed frame. The aforementioned patents do not address these problems, nor do they provide means for transferring weight placed within the drawers directly to the support surface.

Applicant has disclosed an under bed storage unit including weight transfer means for transferring weight directly from the support frame to the support surface in the copending U.S. patent application Ser. No. 944,016, filed Dec. 22, 1986 and assigned to the assignee of the present invention.

Applicant herein provides an improved assembly including fewer parts, the assembly being much simpler to construct and attach to a bed frame. The assembly further provides a novel weight transfer means.

SUMMARY OF THE INVENTION

In accordance with the present invention, there is provided a bed frame assembly including a plurality of rails connected to form a substantially rectangular frame and leg means for supporting the rails above the floor. The assembly includes at least one drawer. Drawer support means supports the drawer from below the frame. The drawer support means is substantially C-shaped when viewed in plan view and has two spaced parallel portions and an intermediate portion interconnecting the parallel portions. The parallel portions define a plan. Connecting means connects the parallel portions to one of the rails. Weight transfer means transfers weight applied to the drawer directly from the drawer support means to the floor. The weight transfer means includes an integral portion of the drawer support means curving below the plane defined by the parallel portions.

FIGURES IN THE DRAWINGS

Other advantages of the present invention will be readily appreciated as the same becomes better understood by reference to the following detailed description when considered in connection with the accompanying drawings wherein:

FIG. 1 is a perspective view of a bed frame assembly constructed in accordance with the present invention;

FIG. 2 is an exploded perspective view of the present invention;

DETAILED DESCRIPTION OF THE DRAWINGS

Figure 3:
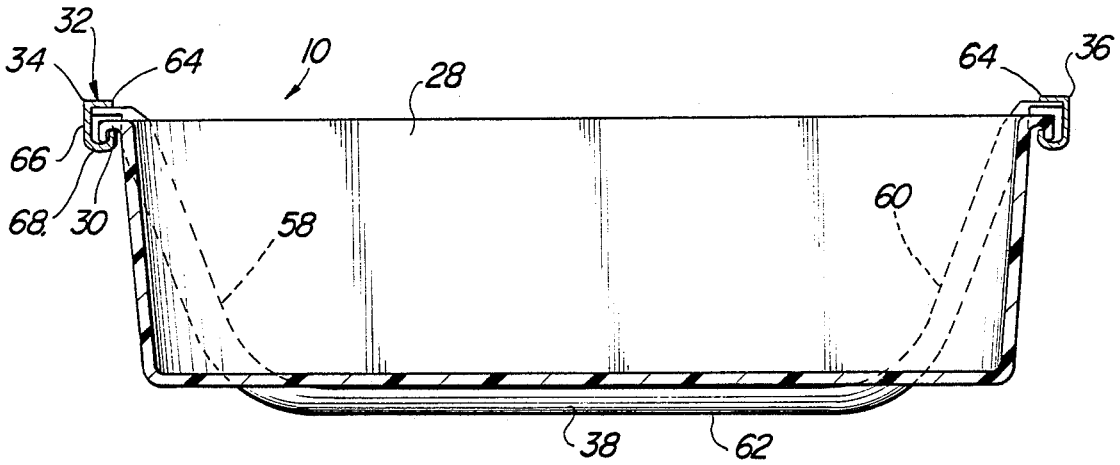
FIG. 3 is a cross sectional view taken substantially along lines 3—3 of FIG. 1.

An underbed storage unit constructed in accordance with the present invention is generally shown at 10 in the Figures.

Referring to FIG. 1, a bed assembly generally indicated at 11 includes frame 12 including a pair of side rails 14 interconnected by end rails 16. Usually, the end rails 16 are adjustable to adjust the width of the frame 12. Accordingly, the frame 12 can be adapted to twin, queen, or king size mattresses. The rails, 14,16 are generally angle irons which are L-shaped when viewed in cross section. The side rails 14 include a vertical portion 18 and a horizontal portion 20.

The bed frame 12 includes four legs 22 for supporting the rails 14,16 above the floor 24.

The underbed storage 10, as shown in FIG. 1, actually includes four separate units generally indicated at 26 mounted on the frame 12. Each unit 26 includes a drawer 28 having peripheral flanges 30 slideably mounted on a drawer support means 32.

The drawer support means 32 supports the drawer 28 from below the frame 12. Accordingly, a mattress can be placed on the frame, the space below the frame 12 being utilized for storage.

The drawer support means is substantially C-shaped when viewed from above in plan view. The drawer support means 32 has two spaced parallel portions 34,36 and an intermediate portion 38 interconnecting the parallel portions 34,36. The parallel portions 34,36 define a plane, the plane being substantially parallel to the plane defined by the bed frame 12.

Figure 4:
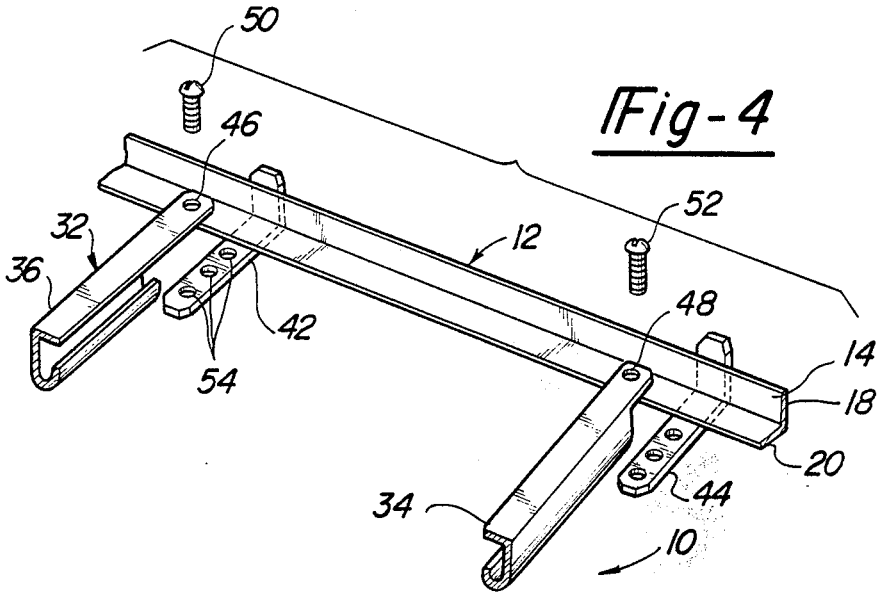
FIG. 4 is a perspective fragmentary view partially in cross section of the connecting means of the present invention.
Figure 5:
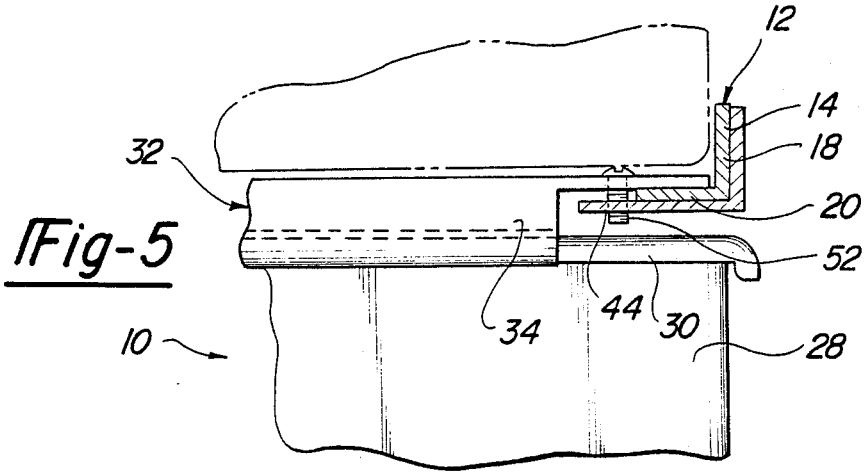
FIG. 5 is a cross sectional view taken substantially along lines 5—5 of FIG. 1.

The parallel portions 34,36 are connected at one of their end portions to the intermediate portion 38. The connection can be a permanent rivet 40,42 allowing relative pivoting movement between the parallel portions 34,36 and the intermediate portion 38. The riveted connection allows for the assembly to assume a folded condition, making shipping of the assembly easier by taking up a minimum amount of room in packaging. The other end of the parallel portions 34,36 can be connected to the angle iron 14 of the bed frame 12 by connecting means, such as by clamp members 42,44, as shown in detail in FIG. 4. The end portions of the parallel portions 34,36 have openings 46,48 therethrough. Fasteners 50,52 connect the members 42,44 to the parallel portions 34,36, clamping the angle iron 14 therebetween, as shown in FIG. 5 in the assembled condition. Each of the clamp members 42,44 have a plurality of openings 54 along their length to allow for adjustment of the effective length of the assembly.

The assembly includes weight transfer means for transferring weight applied to the drawer 28 directly from the drawer support means 32 to the floor 24. Unlike prior art assemblies which include storage units which transfer weight solely to the bed frame or require a cabinet structure, the present invention provides weight transfer means for transferring weight applied to the drawer directly to the support surface 24. The invention is characterized by the weight transfer means including an integral portion of the drawer support means 32 which curves below the plane defined by the parallel portions 34,36.

In the preferred embodiment shown in the Figures, the intermediate portion 38 includes the integral portion. The intermediate portion 38 comprises a unitary intermediate member 38 having an end connected to each of the parallel portions 34,36 and a curved portion extending therebetween defining the integral portion. The integral portion is substantially C-shaped. The intermediate portion includes a pair of descending leg portions 58,60 and an interconnecting portion 62 extending therebetween. The interconnecting portion 62 comprises a substantially straight portion for engaging the floor 24. This configuration provides for the transfer of weight from each of the parallel portions 34,36 directly to the length of the intermediate portion 38 through the descending legs 58,60. Thusly, all weight is directed inwardly towards the interconnecting portion 62 which transfers weight throughout its length to the floor 24. This construction provides a floor support means comprising essentially three parts, the three parts combining to perfect a weight transfer means through the intermediate portion 38. The structure of the intermediate portion 38 maximizes its weight bearing capacity for transferring weight from the drawer 28 directly to the floor 24.

The parallel portions 34,36 include integral tracks for slidingly supporting the drawer 28. Each of the parallel portions include a flat upper portion 64 and a descending wall 66 extending downwardly therefrom. The descending wall 66 descends downwardly to a curved portion 68. The drawer 28 includes the flange portions 30 for sliding engagement with the curved bottom portions 68. Thusly, the present invention provides a drawer 28 including an integral flange portion 30. Parallel portions 34,36 include integral track means defined by the curved portion 68 extending from the downwardly extending wall 66.

The assembly 10 includes covers 70 extending between the parallel portions 34,36 for covering the portion of drawer 28 disposed between the parallel portions 34,36. The cover can be a cloth member 70 including hook and loop type fasteners, such as the ones sold under the Trademark of Velcro 72 thereon for engaging stick or hook and loop type patches 74 on the descending wall 66 of each of the parallel portions 34,36.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A bed frame assembly (11) comprising: a plurality of rails (14,16) connected together to form a substantially rectangular frame (12); leg means (22) for supporting said rails (14,16) above a floor (24); at least one drawer (28); drawer support means (32) for supporting said drawer (28) from below said frame (12), said drawer support means (32) being substantially C-shaped when viewed in plan view and having two spaced parallel portions (34,36) and an intermediate portion (38) interconnecting said parallel portions (34,36), said parallel portions (34,36) defining a plane; connecting means for connecting said parallel portions to one of said rails; and weight transfer means for transferring weight applied to said drawer (26) directly from said drawer support means (36) to the floor (24), characterized by said weight transfer means including an integral portion of said drawer support means (32) curving below said plane, with at least a portion of said integral portion being in contact with the floor.

2. An assembly as set forth in claim 1 further characterized by said intermediate portion (38) including said integral portion.

3. An assembly as set forth in claim 2 further characterized by said intermediate portion (38) comprising a unitary intermediate member (38) having an end connected to each of said parallel portions (34,36) and a curved portion therebetween defining said integral portion.

4. An assembly as set forth in claim 3 further characterized by said integral portion being substantially C-shaped.

5. An assembly as set forth in claim 4 further characterized by said intermediate portion including a pair of descending leg portions (58,60) descending from said end portions and an interconnecting portion (62) extending between said descending legs (58,60).

6. An assembly as set forth in claim 5 further characterized by said interconnecting portion (62) comprising a substantially straight portion for engaging the floor (24).

7. An assembly as set forth in claim 6 further characterized by said parallel portions (34,36) including integral track means for slidingly supporting said drawer (28).

8. An assembly as set forth in claim 7 further characterized by each of said parallel portions (34,36) including a flat upper portion (64) and a descending wall (66) extending downwardly therefrom and a curved bottom portion (68), said drawer (28) including a flange portion (30) for sliding engagement with said curved bottom portion (68).

9. An assembly as set forth in claim 8 further characterized by said flange (30) being an integral portion of said drawer (28).

10. An assembly as set forth in claim 1 further characterized by including cover means (70) extending between said parallel portions for covering said drawer (28) when said drawer is disposed between said parallel portions (34,36).

11. A storage assembly (10) of the type for being secured to a bed frame (12), said assembly (10) comprising: drawer support means (32) for supporting a drawer (28) from below a bed frame (12), said drawer support means including two spaced parallel portions (34,36) defining a plane and an intermediate portion (38) interconnecting said parallel portions (34,36), connecting means for connecting said parallel portions (34,36) to one of said rails; and weight transfer means for transferring weight applied to said drawer (28) directly from said drawer support means to the floor (24), characterized by said weight transfer means including an integral portion of said drawer support means curving below said plane, with at least a portion of said integral portion being in contact with the floor.

12. An assembly as set forth in claim 11 further characterized by said intermediate portion (38) including said integral portion.

13. An assembly as set forth in claim 12 further characterized by said intermediate portion (38) comprising a unitary intermediate member (38) having an end connected to each of said parallel portions (34,36) and a curved portion therebetween defining said integral portion.

14. An assembly as set forth in claim 13 further characterized by said integral portion being substantially C-shaped.

15. An assembly as set forth in claim 14 said intermediate portion including a pair of descending leg portions (58,60) descending from said end portions and an interconnecting portion (62) extending between said descending legs (58,60).

16. An assembly as set forth in claim 15 further characterized by said interconnecting portion (62) comprising a substantially straight portion for engaging the floor (24).

17. An assembly as set forth in claim 16 further characterized by said parallel portions (34,36) including integral track means for slidingly supporting said drawer (28).

18. An assembly as set forth in claim 17 further characterized by each of said parallel portions (34,36) including a flat upper portion (64) and a descending wall (66) extending downwardly therefrom and a curved bottom portion (68), said drawer (28) including a flange portion (30) for sliding engagement with said curved bottom portion (68).

19. An assembly as set forth in claim 18 further characterized by said flange (30) being an integral portion of said drawer (28).

20. An assembly as set forth in claim 11 further characterized by including cover means (70) extending between said parallel portions for covering said drawer (28) when said drawer is disposed between said parallel portions (34,36).

* * * * *